US005979809A

United States Patent [19]

Bartels et al.

[11] Patent Number: 5,979,809

[45] Date of Patent: Nov. 9, 1999

[54] REFINER DISC REMOVAL METHOD AND DEVICE

[76] Inventors: Patrick J. Bartels, N74 W23365 S. Ridgview Cir., Sussex, Wis. 53089; Gregory A. Garasimowicz, S84 W30298 Hickory La., Mukwonago, Wis. 53149

[21] Appl. No.: 09/041,989

[22] Filed: Mar. 13, 1998

[51] Int. Cl.[6] ..... B02C 7/02; B02C 7/11

[52] U.S. Cl. ..... 241/261.3; 241/298; 241/300

[58] Field of Search ..... 241/261.2, 261.3, 241/296, 297, 298, 300

[56] References Cited

U.S. PATENT DOCUMENTS

| | | |
|---|---|---|
| 2,050,005 | 8/1936 | Heegeman . |
| 2,290,427 | 7/1942 | Harrington . |
| 3,611,540 | 10/1971 | Gibu . |
| 3,910,511 | 10/1975 | Leider et al. . |
| 4,104,775 | 8/1978 | Lawless . |
| 5,165,592 | 11/1992 | Wasikowski . |
| 5,425,508 | 6/1995 | Chaney . |
| 5,467,931 | 11/1995 | Dodd . |
| 5,476,228 | 12/1995 | Underberg . |
| 5,492,548 | 2/1996 | Wasikowski . |
| 5,526,992 | 6/1996 | Hawen et al. . |
| 5,690,286 | 11/1997 | Dodd et al. . |
| 5,823,453 | 10/1998 | Garasimowicz . |
| 5,824,265 | 10/1998 | Dodd . |
| 5,875,982 | 3/1999 | Underberg . |

OTHER PUBLICATIONS

"Equipment," J & L Fiber undated brochure. (No date given).

"Quick release plate removal system from J & L," 1997 J & L Fiber Services, Inc. brochure. [No date given].

"Save time, manpower and headaches with the quick release plate release plate removal system from J & L," 1997 J & L Fiber Services, Inc. brochure.

*Primary Examiner*—John M. Husar

*Attorney, Agent, or Firm*—Nilles & Nilles, S.C.

[57] ABSTRACT

A refiner disc for a fiber refiner having a refiner disc removal device that is integral with and retained by the disc during refiner operation. The removal device includes a biasing element that is extended from the disc against its mounting surface to urge the disc away from the mounting surface. In its preferred embodiment, the biasing element is a threaded removal plug in a threaded hole in the disc. The plug preferably is of one-piece, unitary and headless construction, engaged by a tool during removal, and is no longer than the disc cross section. The hole is spaced from disc mounting bores, can be offset from the center of the disc to increase mechanical advantage during removal, and has a shoulder adjacent a refining surface of the disc for preventing the plug from backing out of the disc during refiner operation. With the mounting bolts loosened or removed, the plug is engaged by the tool and rotated to displace it relative to the disc such that a portion of the plug bears against the mounting surface. Threaded engagement between the plug and the disc or a plug carrier mounted in the disc urges the disc away from the mounting surface as the plug is further rotated until the disc breaks free. Thereafter, the disc can be manually removed.

23 Claims, 5 Drawing Sheets

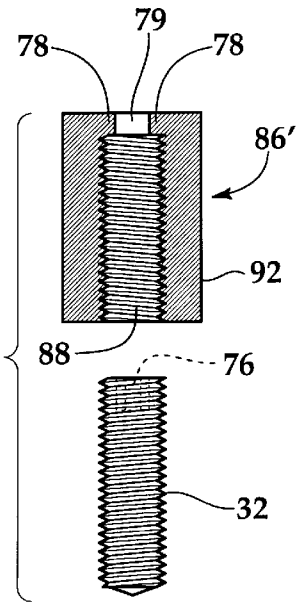
Fig.9
Fig.8
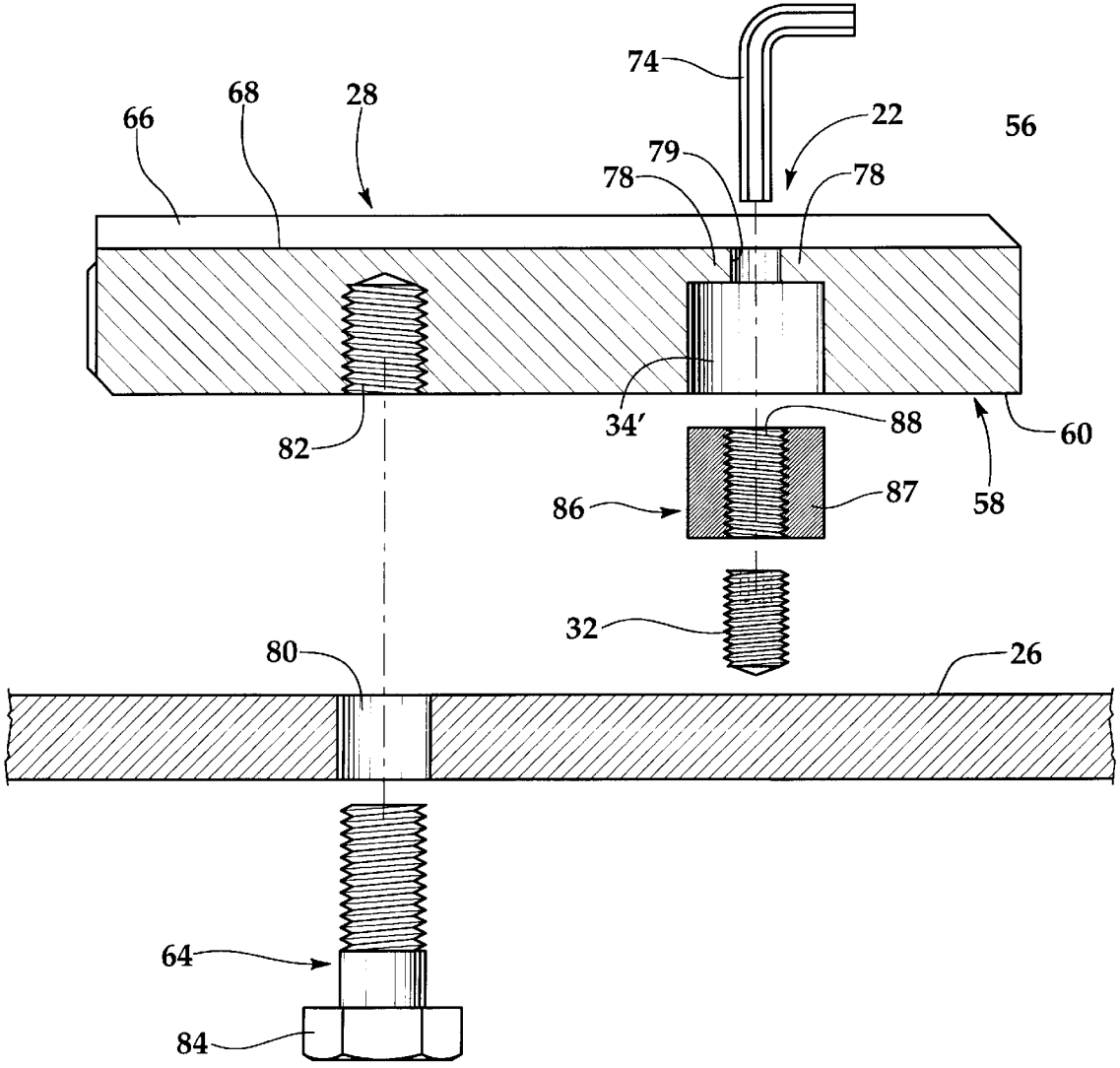

REFINER DISC REMOVAL METHOD AND DEVICE

BACKGROUND OF THE INVENTION

1. Field of the Invention

This invention relates to refiners which prepare fibers for use in paper-based products including papermaking, and to disc refiners in particular.

2. Description of Related Art

For papermaking purposes, wood chips or another raw fiber source are ground into smaller chips or mechanically treated so that the chips may be broken down further and refined into individual fibers. After refining, these individual fibers are typically used to make paper related products, such as sheet paper, toilet paper, paper towels, and other absorbent products.

Disc refiners are used to break down clumps of fibers into individual fibers. A disc refiner typically utilizes pairs of opposed refiner discs. A refiner disc is a disc-shaped steel or steel-alloy casting which has an array of generally radially extending bars or upraised ridges formed in its refining face or refining surface. The refiner disc may be formed of one or more continuous annular discs, or may instead be formed of a plurality of refiner disc segments arranged to form a ring or annulus.

One refiner disc is mounted on a rotor for rotation and the other disc is mounted on another mounting surface opposed to the first refiner disc such that both discs face each other and are very close to each other. The other mounting surface may, for example, be a mounting surface that does not move during refiner operation or another rotor which turns in a direction opposite the first rotor. As wood pulp passes between the opposed refiner discs, relative rotation between the opposed discs desirably refines the pulp.

The flow of vast volumes of stock between the refiner discs inevitably results in wear of the discs, eventually necessitating their replacement. In order to minimize down time and maximize production of the refiner, it is desirable that disc replacement be done as quickly as possible.

However, during the refining operation, extractives and baked fiber are produced and act essentially as a glue that holds the refiner disc against its mounting surface. Therefore, removal of the refiner disc is generally very difficult, time consuming, and ordinarily cannot be achieved by simply removing the mounting bolts that attach the refiner disc to its mounting surface.

U.S. Pat. No. 5,526,992 to Hawén et al. discloses a refiner disc having a plurality of mounting bores and at least one removal hole. The mounting bores extend through the refiner disc and permit the disc to be attached to a mounting surface using bolts. The removal hole extends completely through the refiner disc.

During use of the refining disc, the threaded removal hole is filled with a relatively short covering screw that has a head at its free end which is received in a counterbore of the removal hole. The headed covering screw prevents fibers from penetrating between the disc and the mounting surface. In order to remove the disc, the covering screw is removed and replaced with a second, longer removal screw referred to as a "bursting" screw that is disclosed as having a length longer than the thickness of the disc. The removal screw is threaded into the removal hole completely through the disc until its end bears against the disc mounting surface. Further rotation of the removal screw applies a pressure against the mounting surface that causes the disc to be urged away from the mounting surface enabling it to be removed.

A primary disadvantage of this approach is that it requires two different screws and thus is not of integral construction. This creates the possibility that one of the screws may become lost while the other screw is in use. Therefore, an improved method and device which does not require the use of two separate screws would be very advantageous.

SUMMARY OF THE INVENTION

In order to overcome the drawbacks of the prior art, the present invention provides an improved device and method for more easily freeing a refiner disc from a paper stock refiner to which it is mounted so it can be removed and thereafter replaced. By way of overview, a refiner disc according to the present invention is provided with a removal device that preferably is integral and which includes a refiner disc biasing element that (1) is retained by the disc during refiner operation and, when the refiner is down for replacement of the disc, (2) is movable relative to the disc to cause it to bear against a surface to which the disc is mounted to urge the disc away from the mounting surface so the disc can be removed.

In its preferred embodiment, the biasing element of the disc removal device comprises a generally cylindrical removal plug received in a hole in the disc that is not used for mounting the disc to the mounting surface. Preferably, the plug has a threaded exterior. The removal hole preferably is complementarily threaded for threadably receiving and retaining the plug, even during operation of the refiner. By retaining the plug during refiner operation no other separate plug or screw is used or needed.

If desired, the plug can be received in a carrier received in a removal bore in the disc to facilitate assembly. In one preferred embodiment, the plug is received in a removal hole in a carrier that preferably is a nut press fit into the removal bore in the disc forming thereafter a removal device of integral construction. In another preferred embodiment, the plug is received in a carrier that is a sleeve. Preferably, the carrier is disposed in the removal bore and fixed to the disc such as by brazing, welding, or the like.

The refiner disc can be made up of segments each mounted to a mounting surface of the refiner and disposed in an annular arrangement. Each segment is mounted to its mounting surface typically by one or more bolts.

At least one of the segments of the disc is equipped with the removal plug. If desired, each segment can be equipped with the plug. If desired, a single segment can have more than one removal plug. If desired, a pair of adjacent segments can share a common plug.

In its preferred embodiment, the removal plug is disposed with its longitudinal axis generally parallel to the axis of rotation of the refiner rotor. The plug preferably is of a length sufficient to enable one of its ends to be extend outwardly beyond the disc when the plug is rotated until it bears against the mounting surface such that further plug rotation urges the disc away from the mounting surface. The length of the plug preferably is no greater than the cross sectional thickness of the disc.

The removal plug can be located along the center line of a disc or the center of a disc segment but can also be slightly offset preferably to increase mechanical advantage during removal. The removal hole preferably extends completely through the disc so that the plug can be engaged by a tool inserted into the hole opening in the refining face of the disc during disc removal.

In a preferred embodiment, a portion of the removal hole adjacent the refining face of the disc has a diametrically reduced or necked down portion forming a shoulder. The shoulder prevents removal of the plug from the refining face. The shoulder also prevents the plug from backing out of the removal hole, particularly during refiner operation. As a result, no portion of the plug can extend upwardly beyond the refining face of the disc during refiner operation advantageously preventing the plug from interfering with refiner operation.

In order to remove the refiner disc from the mounting surface, the mounting bolts are preferably at least slightly loosened and the removal plug displaced relative the disc toward the mounting surface. To displace the plug, a tool is inserted into the removal hole opening until it engages the plug. The tool is used to rotate the plug to cause the plug to move toward the mounting surface until the unengaged end of the plug bears against the mounting surface. Additional rotation of the plug causes the plug to apply a removal pressure against the mounting surface which essentially pries the disc loose from the mounting surface so it can be removed.

Objects, features and advantages of the present invention are: to provide a refiner disc removal device that utilizes a removal element that is integral with the refiner disc or disc segment to which it is mounted; to provide a removal device that is not removed during refiner operation; to provide a removal plug that is separate from the mounting bolts; to provide a removal method utilizing only a single step to remove the disc after the mounting bolts are loosened or removed; and is a refiner disc removal device made of a minimum of components, is rugged, simple, flexible, reliable, and durable, and which is of economical manufacture and which is easy to assemble and simple to use.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which:

FIG. 8 is an exploded sectional view of a second preferred embodiment of the disc removal device of this invention depicting the removal plug carried by a carrier received by the disc;

FIG. 9 is an exploded view showing the plug and a second preferred embodiment of the carrier.

DETAILED DESCRIPTION OF THE INVENTION

I. Introduction

Figure 1:
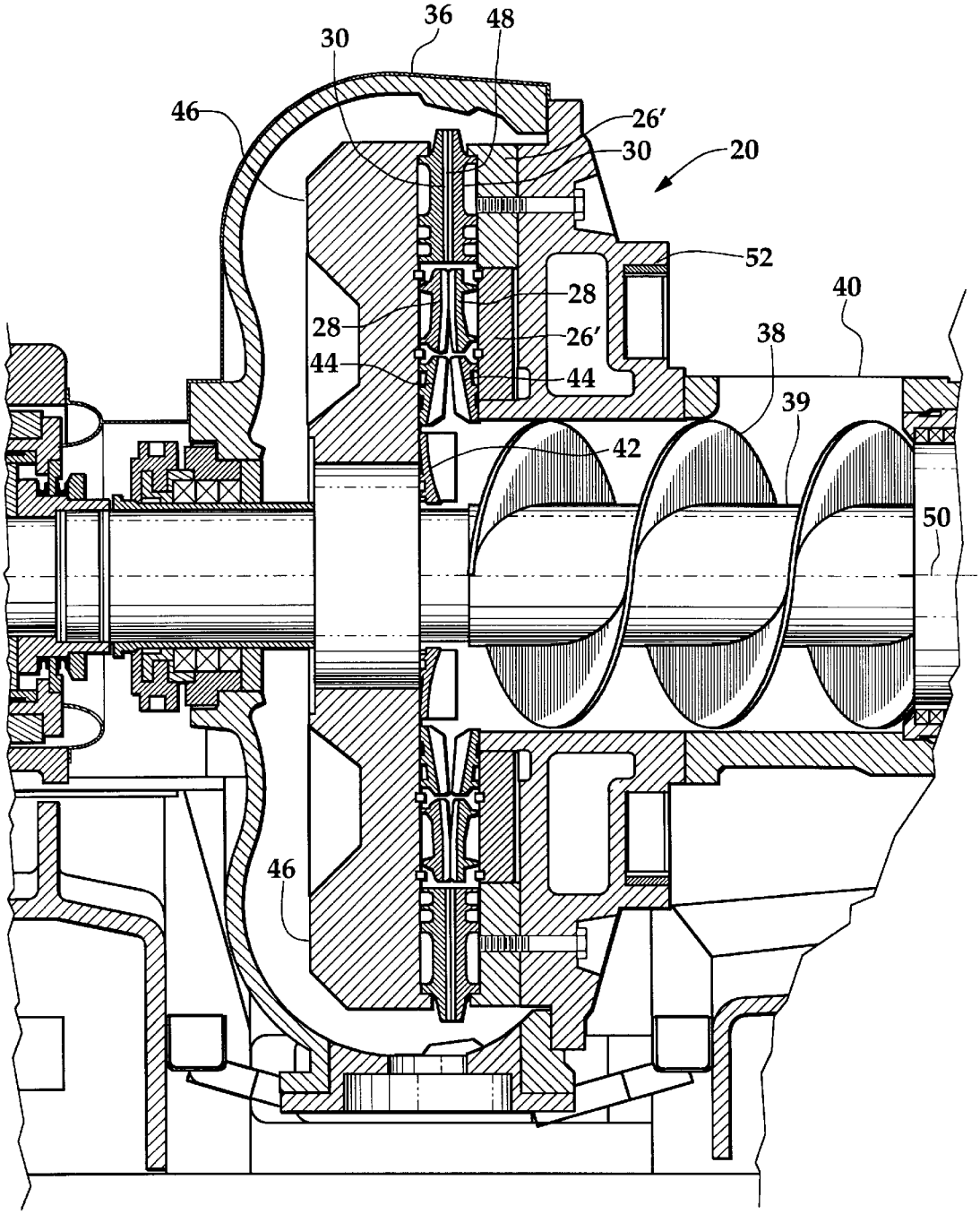
FIG. 1 is a fragmentary cross-sectional view of an exemplary disc refiner having a refiner disc which includes a refiner disc removal device according to the present invention.

Referring now to FIGS. 1–7, a pulp refiner 20 employing a preferred embodiment of a refiner disc removal device 22 of the present invention is shown. In its preferred embodiment, the refiner disc removal device 22 is of integral construction and comprises a refiner disc removal biasing element 24. The biasing element 24 preferably is of one-piece and unitary construction that is carried by at least one of the refiner discs 28 and 30 and preferably is carried by each of the discs 28 and 30. The biasing element 24 is retained by the disc both during refiner operation and during disc removal. The biasing element 24 and disc are constructed and arranged such that the biasing element 24 can be displaced relative the disc against a mounting surface 26 of the disc during disc removal to urge the disc away from the mounting surface 26 to break it free from the mounting surface 26.

In its preferred embodiment, the biasing element 24 is a removal plug 32 received in a bore or hole 34 in the refiner disc. Preferably, both the plug 32 and hole 34 are threaded. When rotated in direction, a portion of the plug 32 extends from the disc and bears against the mounting surface 26 such that further rotation of the plug 32 urges the disc away from the mounting surface 26, freeing the disc so it can be removed. During operation of the refiner 20, the plug 32 is retained by the disc.

II. Refiner

As shown in FIG. 1, the refiner 20 has a housing 36 and an auger 38 mounted therein which helps supply pulp or stock introduced to the refiner 20 through a stock inlet 40. An auger 38 carried by a rotating shaft 39 helps supply stock to an arrangement of treating structure mounted to the housing 36 and a rotating rotor 46. A flinger nut 42 is aligned with the auger 38 and directs the stock radially outwardly to a plurality of opposed sets of breaker bar segments 44.

Each set of breaker bar segments 44 preferably are in the form of sectors of an annulus which together form an encircling section of breaker bars. One set of breaker bar segments 44 is fixed to the rotor 46. The other set of breaker bar segments 44 is fixed to another portion of the refiner, such as a stationary mounting surface 26' of the housing 36 or another rotor (not shown).

The breaker bar segments 44 discharge stock to radially outwardly positioned sets of first refiner discs 28 and second refiner discs 30. The refiner 20 can have more or less than two sets of refiner discs. A first set of the first and second refiner discs 28 and 30 is removably mounted to a mounting surface 26. As is shown in FIG. 1, the mounting surface 26 preferably is the rotor 46. If desired, the mounting surface 26 can be separate from the rotor 46, such as a separate mounting plate (not shown) or another component that is mounted to or carried by the rotor 46 or another component of the refiner 20.

A second set of the first and second refiner discs 28 and 30 is removably mounted to one of the mounting surfaces each labeled with reference numeral 26'. As is shown in FIG. 1, the mounting surface 26' can be a plate 26' carried by an immovable stator 52 supported by the refiner housing 36. If the desired, plate 26' can be carried by another rotor (not shown) that typically rotates in a direction opposite rotor 46.

Preferably, the first set of refiner discs 28 and 30 is disposed parallel to a radially extending plane 48. As is also shown in FIG. 1, the second set of refiner discs 28 and 30 is also disposed parallel to the plane 48 and located relative to the first set of discs 28 and 30 such that they oppose the first set. During operation, the rotor 46 and first set of refiner discs 28 and 30 rotate about an axis 50 causing relative rotation between the first set of refiner discs 28 and 30 and the opposed second set of refiner discs 28 and 30. Since both disc 28 and disc 30 are used to refine fiber that preferably is made of wood and thus are substantially similar, only disc 28 will be referred to further herein.

Figures 2, 3, 5, 6, 7:
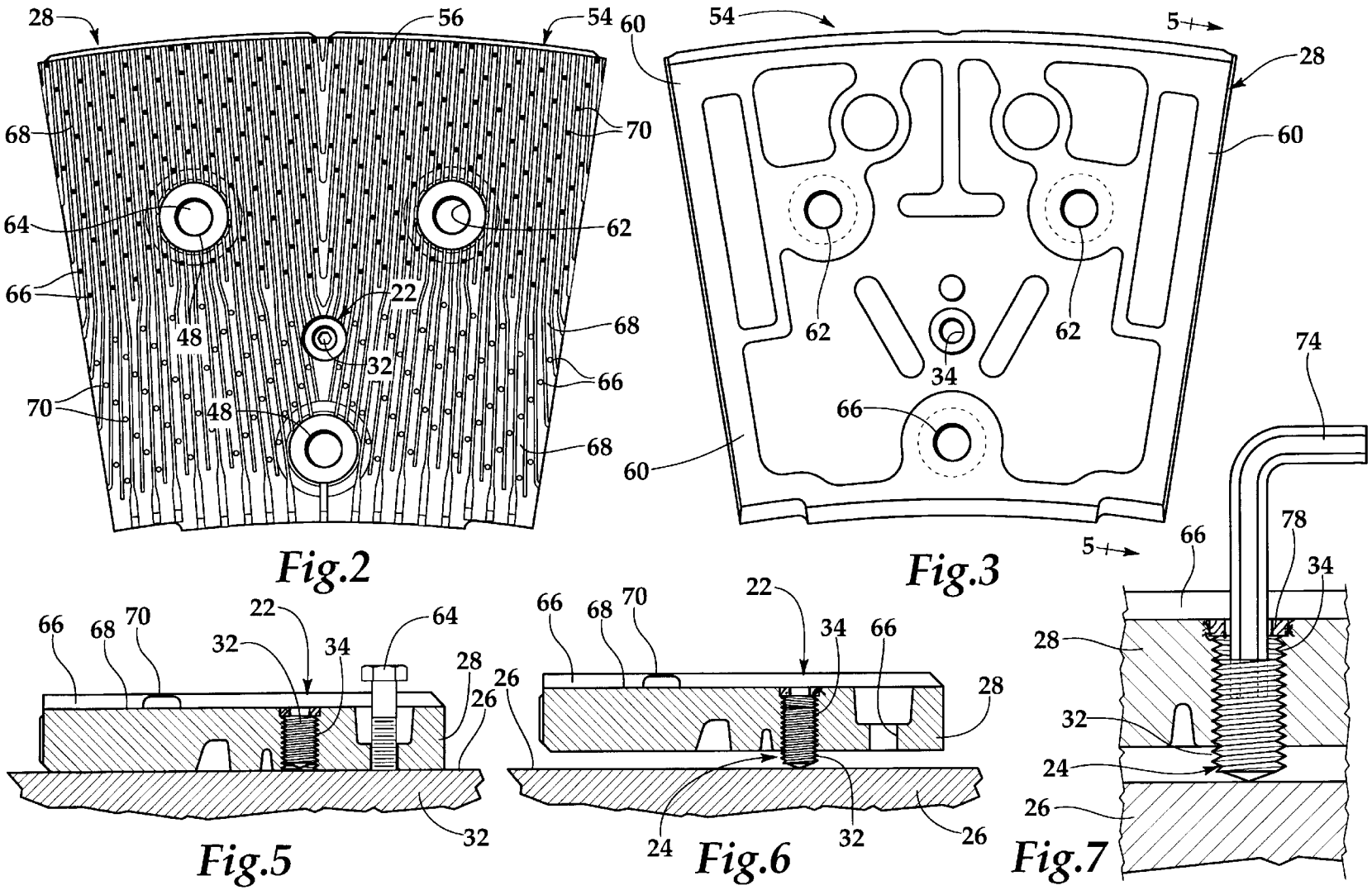
FIG. 2 is a front view of the refining surface of a segment of the refiner disc shown in FIG. 1.
FIG. 3 is a rear view of the refiner disc segment shown in FIG. 2.
FIG. 5 is a side sectional view of the disc segment attached to the mounting surface.
FIG. 6 is a side sectional view showing operation of the disc removal device removing the disc segment from its mounting surface.
FIG. 7 is an enlarged partial fragmentary side sectional view of FIG. 6.

As shown in FIGS. 2 and 3, each refiner disc 28 is preferably comprised of a plurality of refiner disc segments or plates 54 that are arranged in a circle or ring. Each segment 54 has a front refining face 56 and a rear surface 58 with the rear surface 58 having at least one substantially flat land 60 that typically lies substantially flush against the disc mounting surface 26 or 26' when the segment 54 is mounted to the mounting surface. As is shown in FIG. 3, the flat land 60 preferably extends about at least a portion of the periphery of the disc segment 54.

Where the refiner disc is made up of disc segments 54, each segment 54 is removably mounted to the mounting surface 26. The disc segment 54 shown in FIGS. 2–7 has a plurality of through-bores 62 each for receiving a mounting bolt 64. In removably mounting the disc segment 28 to the mounting surface 26, each bolt 64 is inserted through one of the bores 62 and threaded into a complementary threaded hole (not shown) in the mounting surface 26. As is shown in FIG. 2, each bolt 64 has an exposed head constructed and arranged to be rotated using a tool.

While mounting bolts 64 that extend completely through the disc segment 54 can be used to removably mount the segment 54, other methods and devices can be used to removably mount the segment or disc. For example, mounting bolts 64 of the general type shown in FIG. 5 can engage the disc 28 or segment 54 from the rear. Referring to FIG. 8, at least one mounting bolt 64 can extend through a bore 80 in the mounting surface 26 and threaded into a threaded bore 82 in the rear surface 58 of the disc or segment. In another method of mounting, the head 84 of the bolt 64 is received in a slot or pocket (not shown) in the rear surface 58 of the disc or segment and threaded into the mounting surface 26. If desired, the disc segments 54 can be of interlocking construction with adjacent segments 54 interlocking with each other and at least one of the segments mounted directly to the mounting surface 26.

Figure 4:
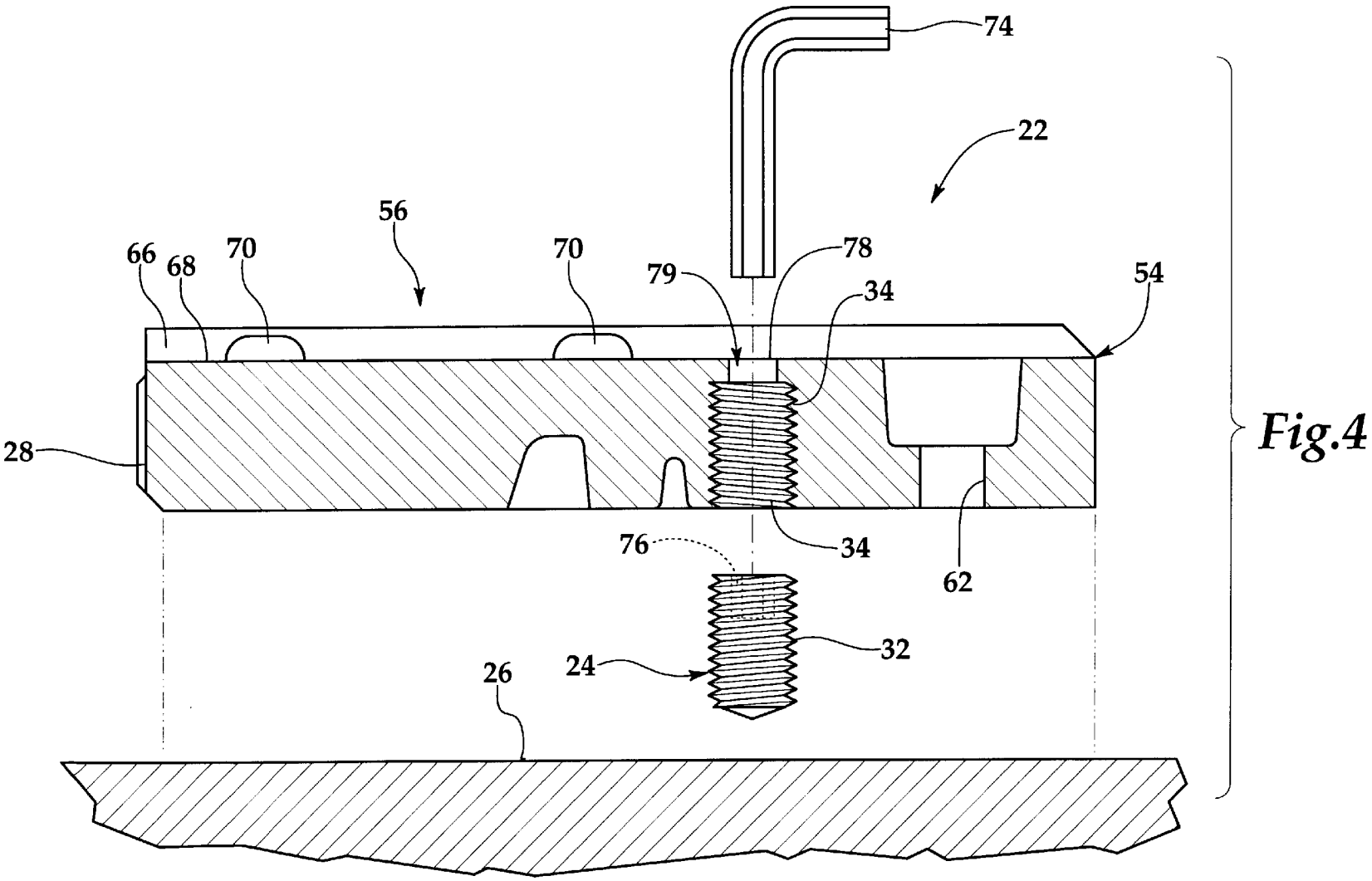
FIG. 4 is an exploded side sectional view the disc segment, removal plug and mounting surface of the disc segment.

Referring to FIGS. 4–6, the refining surface 56 of each segment 54 has a plurality of pairs of generally upstanding elongate radially extending ridges or bars 66 with each adjacent pair spaced apart defining a flow channel 68 therebetween. During refining, stock flows radially outwardly through each channel 68 and over and around each bar 66. Within each channel, the segment 54 can have one or more upraised dams 70, each of which at least partially obstructs stock flow through a channel 68 in a manner that causes stock to flow over the dam 70 and across adjacent bars 66 during refining, preferably to enhance refining action.

During operation of the refiner 20, stock is processed to free individual fibers, typically for wood fibers, in preparation for making paper or another fiber-based product by passing the stock between the opposed sets of first and second refiner discs 28 and 30. The flinger nut 42 has radial bars which transport the stock radially outwardly under the centrifugal forces developed by the rotating motion of the rotor 46 and attached flinger nut 42. The breaker bar segments 44 receive stock discharged radially outwardly from the flinger nut 42 which then passes radially outwardly between the opposed sets of refiner discs 28 and 30.

III. Refiner Disc Removal Device

Inevitably, as a result of operation of the refiner 20, replacement of the refiner disc 28 eventually becomes necessary as it wears out. Accordingly, the refiner disc 28 preferably includes at least one refiner disc removal device 22 of this invention, one embodiment of which is shown in FIGS. 2–7, in conjunction with the refiner disc 28. Where the refiner disc 28 is segmented, at least one segment 54 includes the removal device 22. If desired, each segment 54 can be equipped with the removal device 22. If desired, each segment 54 or disc 28 can be equipped with more than one removal device 22.

In its preferred embodiment, the refiner disc removal device 22 comprises the removal plug 32 and is assembled into the body of the refiner disc 28 or disc segment 54. By this construction, the disc 28 and removal plug 32 and disc segment 54 and removal plug 32 form an integral assembly. As is shown in FIG. 2, the removal plug 32 and hole 34 are separate from mounting bores 62 and mounting bolts 64.

Preferably, the removal plug 32 is of generally cylindrical construction and is threaded. Preferably, the plug 32 has a length no greater than the cross sectional thickness of the disc segment 54 and no less than about one-quarter inch. If desired, the plug 32 can be selected to have a length equal to the maximum cross sectional thickness of the segment 54 such that one end is substantially flush with the axially outermost edge 72 of the bars 66 of the segment refining surface 56 and its other end is substantially flush with the land 60. In the preferred embodiment shown in FIGS. 2–7, the plug 32 preferably has a length about equal to the cross sectional thickness of the segment 54 taken from the bottom of the channel 68 to the land 60. Preferably, the plug 32 is of headless construction. In its preferred embodiment, the plug 32 is a screw that preferably is a set screw that preferably is of headless construction.

As is shown in FIG. 5, the preferred embodiment of the removal plug 32 has a length substantially the same as the cross sectional thickness of the disc segment 54 in its channel region such that no part of the plug 32 extends upwardly into any channel 68. By this choice of preferred length, stock flow during refining is advantageously not impeded in the vicinity of the plug 32. Moreover, by this choice of length, the plug 32 remains exposed and can be easily engaged by a tool 74 during disc segment 54 removal, preferably requiring a minimum of cleaning in the region of the plug 32 beforehand.

The end of the plug 32 exposed in FIG. 2 at the refining surface 56 is constructed and arranged to facilitate engagement by the tool 74. In the preferred embodiment, the plug 32 has a tool receptacle 76 (in phantom in FIG. 4) that preferably is a hexagonal socket 76 for receiving a hex head key 74. If desired, the plug 32 can have a tool receptacle for receiving another type of socket or a screw driver. In any event, the tool 74 can be used manually to rotate the plug 32 to remove the disc segment 54 or can be driven by another power source such as a drill or another type of prime mover (not shown).

As is shown in FIG. 5, the length of the threaded hole 34 preferably is at least about the same as the length of the plug 32 and is spaced from all of the mounting bores 62. The length of the hole 34 can be longer than the plug 32. Preferably, the threaded hole 34 has a diametrically necked down shoulder 78 adjacent the refining face 56, which captures the removal plug 32 when the disc segment 54 is mounted to prevent the plug 32 from backing out during refining. The shoulder 78 also defines an access port 79 in the refining surface 56 through which the tool 74 is inserted. If desired, the hole 34 can be formed without any such shoulder.

The hole 34 and plug 32 can be located along the center line of the disc 28 or center of the disc segment 54. So as to increase mechanical advantage during disc segment removal, the hole 34 and plug 32 can be offset from the center of the disc segment 54. By offsetting the hole 34 and plug 32 from the center of the segment 54, a moment is created about at least one edge of the segment 54 as the plug 32 is urged against the mounting surface 26 during removal that helps break the segment 54 free of the mounting surface 26.

In another preferred embodiment of the integral disc removal device 22' shown in FIGS. 8 and 9, the removal plug 32 is carried by a carrier 86 that is received in hole 34' to facilitate assembly of the device 22'. In the preferred embodiment shown in FIG. 8, the carrier 86 can be a hexagonal nut 87 or the like that is received in the hole 34' and fixed to the segment 54. The carrier 86 can be welded, brazed or otherwise adhesively fixed to the segment. If desired, the carrier 86 can be press fit into the hole 34'. The carrier 86 has a threaded bore 88 for threadably receiving the plug 32. Shoulder 78 preferably defines an access port 79 through which tool 74 is inserted to engage the plug 32. Preferably, the access port 79 has a diameter less than the outer diameter of the plug 32 to prevent withdrawal of the plug 32 from the refiner face 56 of the segment 54.

In another preferred embodiment shown in FIG. 9, the carrier 86' is a sleeve 92 received in an appropriately sized and shaped bore 34'. In the preferred embodiment shown in FIG. 9, the sleeve 92 is of elongate and generally cylindrical construction.

Figure 10:
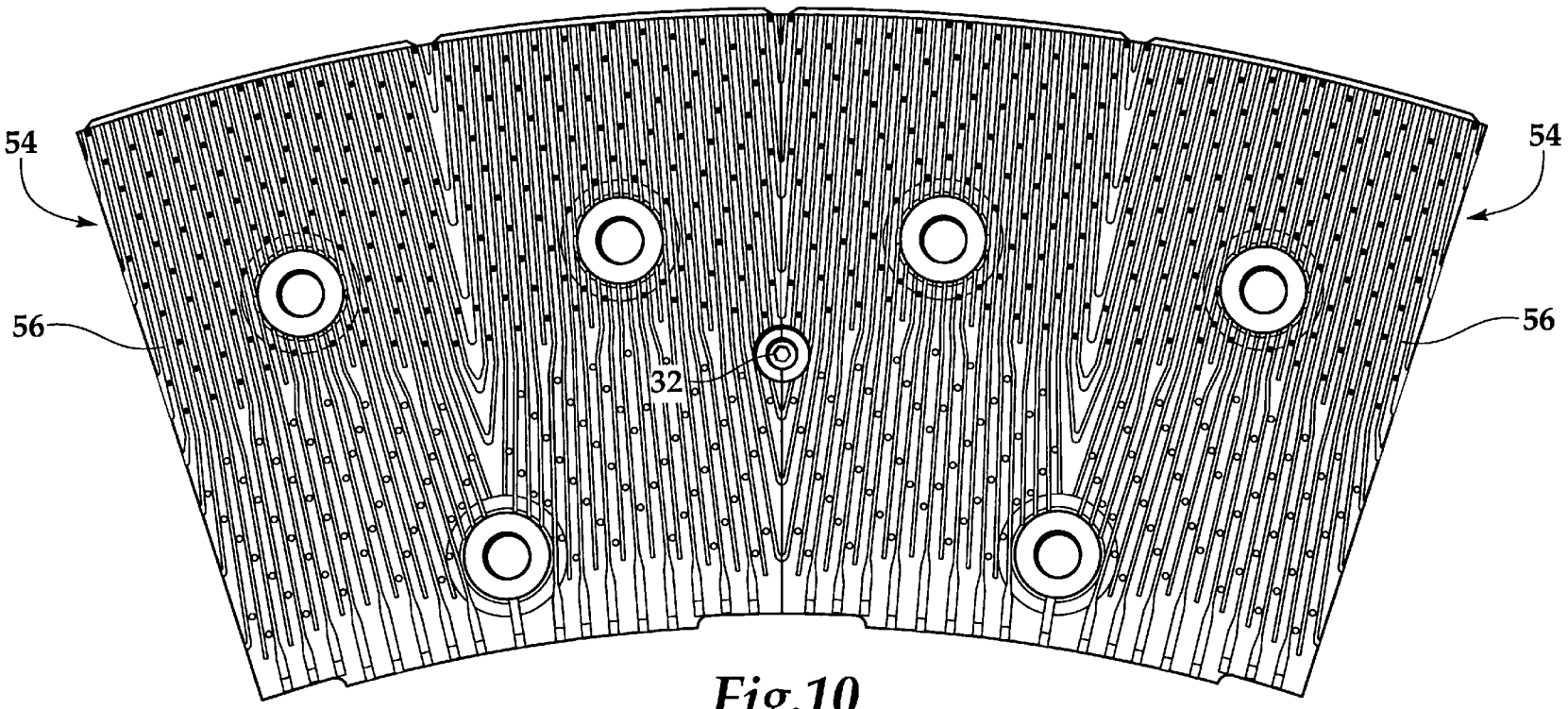
FIG. 10 is a front view of a pair of adjacent disc segments with the removal plug disposed between them.

In another preferred embodiment shown in FIG. 10, the removal plug 32 is shared by or common to a pair of adjacent refiner disc segments 54. Bore 34 is formed by a pair of opposed arcuate and ridged channels (not shown) in the sidewall of each adjacent disc segment 54.

IV. Use and Operation

In use, the disc removal device 22 of this invention is used to remove refiner discs and refiner disc segments of all types of paper stock refiners and wood fiber refiners including the single disc refiner shown in FIG. 1, counterrotating refiners, double disc or twin refiners, and conical disc refiners that are known in the industry as CD refiners. In use, the disc removal device 22 is used to remove a disc 28 or disc segment 54 from its mounting surface 26.

In order to remove the refiner disc 28 or segment 54, the mounting bolts 64 are loosened. If desired, they can be removed before extending the removal plug 32, but preferably are simply loosened to prevent the segment 54 from uncontrollably popping off during extension of the plug 32.

Then, the tool 74 is inserted through opening 79 into bore 34 into the receptacle 76 in the plug 32 thereby engaging the plug 32. It may first be necessary to drill toward the plug 32 through access port 79 to remove compacted fibers which have accumulated to expose the plug 32 so it can be engaged by the tool 74.

The tool 74 is used to turn the removal plug 32 in one direction to displace the plug 32 toward the mounting surface 26. The plug 32 first bears against the mounting surface 26 and thereafter further rotation urges the disc 28 or segment 54 away from the mounting surface 26 creating a pressure which breaks the disc 28 or segment 54 loose from the pulp and the extractives that have built up during refiner operation.

Finally, when the disc 28 or segment 54 is sufficiently broken free of the mounting surface 26, the mounting bolts 64 are completely removed from their bores 62 so that the disc 28 or segment 54 may be completely removed from the mounting surface 26. Of course, where the disc 28 or segment 54 is to be resurfaced, the removal plug 32 is rotated in the opposite direction to retract it back into the disc segment 54.

After the mounting bolts 64 are removed, the disc 28 or segment 54 preferably is manually removed completely from the refiner 20 thereafter permitting another disc 28 or segment 54 to be mounted to the refiner 20.

Advantageously, therefore, the refiner disc removal method and device according to the present invention requires the use of only a single removal plug 32. All of the necessary removal hardware is retained within the refiner disc segment 54, even during refining operation.

Moreover, removing the refiner disc or disc segment requires only a single step in addition to loosening or removing the mounting bolts 64, namely, simply turning the removal plug 32 until the disc or segment breaks free.

It should be understood that the refiner disc removal device 22 of this invention may be employed with refiners of various configurations employing various types and consistencies of stock. The refiner discs 28 and 30 and segments 54 described and illustrated may be used with any suitable disc refiner and such disc refiner may have one or more rotors and one or more counter-rotating or stationary refiner disc segments and refiner discs.

Although the refiner discs 28 and 30 are shown to be constructed of annular pie-shaped segments, they can be formed as continuous annular discs. Furthermore, the refiner discs 28 and 30 may be formed as a single annular section, or as plural sections. The refiner disc segments 54 and refiner discs 28 and 30 are typically cast of materials such as white cast iron and stainless steel or other alloys combining the features of strength, wear resistance, and cost effectiveness.

It is also to be understood that, although the foregoing description and drawings describe and illustrate in detail one or more embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

It is claimed:

1. A refiner for refining a fibrous stock slurry comprising:

a housing having a stock inlet;

a pair of opposed refiner disc mounting surfaces disposed inside the housing with one of the refiner disc mounting surfaces rotatable relative to the other one of the refiner disc mounting surfaces about an axis of rotation;

a refiner disc removably carried by one of the mounting surfaces, the refiner disc having a rear surface disposed toward the one of the mounting surfaces, a front refining surface comprised of a plurality of pairs of upraised bars, a cross-sectional thickness, and a refiner disc removal hole that has a front opening in the refining surface and a rear opening disposed adjacent the rear surface;

a generally cylindrical threaded refiner disc removal plug received in the refiner disc removal hole, the threaded refiner disc removal plug having a front end disposed adjacent the front refining surface and a rear end disposed toward the one of the mounting surfaces, the threaded refiner disc removal plug having an axial length no greater than the cross sectional thickness of the refiner disc;

wherein the threaded refiner disc removal plug remains disposed in the refiner disc during operation of the refiner; and wherein the threaded refiner disc removal plug is rotatable relative to the refiner disc in one direction to cause the rear end of the refiner disc removal plug to bear against the mounting surface to urge the refiner disc away from the mounting surface.

2. The refiner of claim 1 wherein the refiner disc further comprises a plurality of refiner disc mounting bores each for receiving a mounting bolt that mounts the refiner disc to the mounting surface with each of the refiner disc mounting bores spaced from the refiner disc removal hole.

3. The refiner of claim 1 wherein a portion of the refiner disc removal hole adjacent the front opening is smaller than the cross section of the refiner disc removal plug to prevent the refiner disc removal plug from backing out the front opening of the refiner disc removal hole.

4. The refiner of claim 1 wherein the refiner disc removal hole is disposed radially outwardly of a circumferentially extending centerline of the refiner disc for increasing the mechanical advantage of the threaded removal plug when it is extended from the refiner disc and bears against the mounting surface.

5. The refiner of claim 1 wherein each one of the plurality of pairs of upraised bars having an axially outermost refining edge and the cross sectional thickness of the refiner disc is defined as the distance between the outer axial refining edge of one of the upraised bars and the rear surface of the refiner disc.

6. The refiner of claim 1 wherein the refiner disc removal plug is exteriorly threaded along its entire length.

7. The refiner of claim 6 wherein the refiner disc removal plug comprises a headless bolt.

8. The refiner of claim 7 wherein the refiner disc removal plug has a socket recess in its front end for receiving a socket driver.

9. The refiner of claim 1 further comprises a tubular carrier received in the refiner disc removal hole that is internally threaded and the threaded removal plug is received in the threaded carrier and threadably engages the threaded carrier.

10. The refiner of claim 9 wherein the carrier comprises a nut fixed to the refiner disc.

11. The refiner of claim 1 wherein the refiner disc is comprised of a plurality of pairs of pie-shaped segments.

12. A refiner disc for a refiner that refines a fibrous stock slurry comprising:

a plate having a rear surface disposed toward a mounting surface of the refiner, a front refining surface comprised of a plurality of pairs of upraised bars, a cross-sectional thickness, and a threaded refiner disc removal hole that has a front opening in the refining surface and a rear opening in the rear surface;

a generally cylindrical threaded refiner disc removal plug threadably received in the refiner disc removal hole, the threaded refiner disc removal plug having a front end disposed adjacent the front refining surface and a rear end disposed toward the one of the mounting surfaces, the threaded refiner disc removal plug having a length no greater than the cross sectional thickness of the refiner disc;

wherein the threaded refiner disc removal plug remains disposed in the refiner disc during operation of the refiner; and wherein the threaded refiner disc removal plug is rotatable relative to the refiner disc in one direction to cause the rear end of the refiner disc removal plug to bear against the mounting surface to urge the refiner disc away from the mounting surface.

13. The refiner disc of claim 12 further comprising a plurality of refiner disc mounting bores each for receiving a mounting bolt that mounts the refiner disc to the mounting surface with each of the refiner disc mounting bores spaced from the refiner disc removal hole.

14. The refiner disc of claim 12 wherein a portion of the refiner disc removal hole adjacent the front opening is smaller than the cross section of the refiner disc removal plug to prevent the refiner disc removal plug from backing out the front opening of the refiner disc removal hole.

15. The refiner disc of claim 14 wherein the front opening is defined by an inturned shoulder that opposes removal of the refiner disc removal plug.

16. The refiner disc of claim 12 wherein the refiner disc removal hole is disposed radially outwardly of a circumferentially extending centerline of the refiner disc for increasing the mechanical advantage of the threaded removal plug when it is urged from the refiner disc against the mounting surface.

17. The refiner disc of claim 12 wherein each one of the plurality of pairs of upraised bars having an axially outermost refining edge and the cross sectional thickness of the refiner disc is defined as the distance between the outer axial refining edge of one of the upraised bars and the rear surface of the refiner disc.

18. The refiner disc of claim 12 wherein the refiner disc removal plug is exteriorly threaded along its entire length.

19. The refiner disc of claim 18 wherein the refiner disc removal plug comprises a headless bolt.

20. The refiner disc of claim 19 wherein the refiner disc removal plug has a socket in its front end for receiving a socket tool.

21. The refiner disc of claim 12 wherein the refiner disc is comprised of a plurality of pairs of pie-shaped refiner disc segments and the refiner disc removal hole and removal plug is disposed in one of the refiner disc segments.

22. A refiner disc for a refiner that refines a fibrous stock slurry comprising:

a plate having a rear surface disposed toward a mounting surface of the refiner, a front refining surface comprised of a plurality of pairs of upraised bars, a cross-sectional thickness, and a threaded refiner disc removal hole that has a front opening in the refining surface and a rear opening in the rear surface;

a generally cylindrical and headless threaded refiner disc removal bolt received in the refiner disc removal hole, the threaded refiner disc removal bolt having a front end disposed adjacent the front refining surface with a tool-receiving recess therein and a rear end disposed toward the one of the mounting surfaces, and a length no greater than about the cross sectional thickness of the refiner disc;

wherein the threaded refiner disc removal bolt is retained in the refiner disc during operation of the refiner; and wherein the threaded refiner disc removal bolt is rotatable relative to the refiner disc in one direction to cause the rear end of the refiner disc removal plug to bear against the mounting surface to urge the refiner disc away from the mounting surface.

23. A refiner disc for a refiner that refines a fibrous stock slurry comprising:

a plate having a rear surface disposed toward a mounting surface of the refiner, a front refining surface comprised of a plurality of pairs of upraised bars, a cross-sectional thickness, and a threaded refiner disc removal hole that has a front opening in the refining surface and a rear opening in the rear surface;

a generally cylindrical and headless threaded refiner disc removal bolt received in the refiner disc removal hole, the threaded refiner disc removal bolt having a front end disposed adjacent the front refining surface with a tool-receiving hexagonal socket therein and a rear end disposed toward the one of the mounting surfaces, and a length no greater than about the cross sectional thickness of the refiner disc;

wherein the threaded refiner disc removal bolt is retained in the refiner disc during operation of the refiner;

wherein the threaded refiner disc removal bolt is rotatable relative to the refiner disc in one direction to cause the rear end of the refiner disc removal plug to bear against the mounting surface to urge the refiner disc away from the mounting surface; and wherein the front opening of the refiner disc removal hole is smaller than the cross section of the refiner disc removal bolt to prevent the refiner disc removal bolt from being withdrawn through the front opening from the refiner disc removal hole.

* * * * *

UNITED STATES PATENT AND TRADEMARK OFFICE

CERTIFICATE OF CORRECTION

PATENT NO. : 5,979,809
DATED : November 9, 1999
INVENTOR(S) : Patrick J. BARTELS et al.

It is certified that error appears in the above-identified patent and that said Letters Patent is hereby corrected as shown below:

On the title page,

Add at [73] Assignee: J & L Fiber Services, Inc.,
Waukesha, Wisconsin

Signed and Sealed this

Fourteenth Day of March, 2000

*Attest:*

Q. TODD DICKINSON

*Attesting Officer*

*Commissioner of Patents and Trademarks*